United States Patent [19]

Miller

[11] 4,177,955

[45] Dec. 11, 1979

[54] MILL WEAR MEMBER

[75] Inventor: Larry G. Miller, Akron, Ohio

[73] Assignee: The B. F. Goodrich Company, Akron, Ohio

[21] Appl. No.: 911,856

[22] Filed: Jun. 2, 1978

[51] Int. Cl.[2] ..... B02C 17/22

[52] U.S. Cl. ..... 241/183

[58] Field of Search ..... 241/102, 181–183, 241/284, 299

[56] References Cited

U.S. PATENT DOCUMENTS

| | | | |
|---|---|---|---|
| 2,210,357 | 8/1940 | Beament | 241/182 X |
| 3,107,867 | 10/1963 | Svensson et al. | 241/102 |
| 3,378,209 | 4/1968 | Crocheron | 241/182 X |
| 3,804,346 | 4/1974 | Norman | 241/182 |

*Primary Examiner*—Howard N. Goldberg
*Attorney, Agent, or Firm*—Harry F. Pepper, Jr.

[57] ABSTRACT

A liner member for rotary drum-type mills comprises a resilient portion of wear, abrasion and impact resistant elastomeric material with a rigid plastic portion bonded to each side thereof. The liner member is specially adapted for mills which employ spaced lifter bars along selected interior surface portions of the mill with the liner member fitted between the lifter bars such that the resilient portion of the liner is disposed to protect the walls of the mill from wear, abrasion and impact while the liner is held in position by the lifter bars which bear against the two rigid portions bonded to the sides of the resilient portion.

4 Claims, 3 Drawing Figures

MILL WEAR MEMBER

BACKGROUND OF THE INVENTION

The invention relates to rotary drum type mills, such as ball, rod, pebble or autogeneous mills and particularly to lining structures used in such mills.

Common devices used to grind or comminute solid material, such as ores, are drum-like structures adapted to rotate about a horizontal axis where the charge in the mill is lifted or carried up the ascending side of the drum and tumbles back down over itself producing pulverization of the charge. This pulverizing action can be "autogeneous" through interaction between particles of the charge or may be enhanced by providing grinding media in the mill, such as balls, rods or pebbles, Because of this action, mills of this type are often provided with replaceable interior lining members to protect the mill interior from the impact, abrasion and wear effected by the grinding action. These liners are often fabricated of vulcanized rubber.

Many of the above described mills also include lifter bars secured to various interior surface portions of the mill. These lifter bars are typically provided longitudinally of the mill and at one or both of the annular end closures of the mill. The longitudinal lifter bars are normally disposed at selected circumferential spacings while the lifter bars at the ends of the mill are disposed along spaced radii extending from the axis of rotation.

Liner members or plates are normally positioned between adjacent lifter members and their shape generally reflects the shape of the spaces between adjacent lifters (e.g. liners are generally of rectangular shape when between longitudinal lifters and wedge or pie-shaped when between radial lifters).

When lifter members of metal, such as steel, are used in these rotary members certain problems arise due to the high fastening torque applied to properly secure the lifters to the mill walls. Generally the lateral margins of the lifter bars must forcibly bear upon a lateral margin of an adjacent liner member. It has been found that when using all rubber liners between steel lifters, that this high torque applied causes the margins of the rubber liner to squeeze or pop out from the underside of the lifter bar bearing upon it. Thus, use of all rubber lining members for disposition between such metal lifters have not been entirely satisfactory. It has been proposed to reinforce these rubber liners with steel plates or bars embedded within the margins of the liner member. This, however, adds considerable weight to the liner and thus to the mill as a whole. Also, mill liners with steel reinforced margins are complicated and expensive from a manufacturing standpoint.

SUMMARY

The present invention provides a liner member which is, for purposes of practical application, a vulcanized rubber member but which is actually a multi-component structure. Specifically, the liner member according to the present invention comprises a resilient portion of vulcanized abrasion resistant elastomeric material with a rigid portion bonded to each side of the resilient portion. Preferably, each rigid portion is plastic and more preferably is composed of ultra high molecular weight polyethylene, a particular plastic capable of being fused or mold bonded to rubber. Using such ultra-high molecular weight polethylene enables an in situ formation of the multi-component as a unitary structure as well as providing a strong rubber to plastic bond. The liner member described is lightweight and is particularly adaptable for disposition between metal lifters in a rotary drum-type mill because the rigid plastic portion along the margins of the resilient rubber portion of the liner members are the bearing surfaces against which portions of a pair of adjacent lifter bars will bear when the liner is placed in the mill. In other words, when the lifter bars are fastened to the interior mill wall or the ends of the mill the margins of each will satisfactorily bear against the rigid portions of adjacent liner members placed within the spaces between the lifters under high fastening torques applied to the lifters.

THE DRAWINGS

In the drawings which accompany and are made part of this specification:

DETAILED DESCRIPTION

Figure 1:
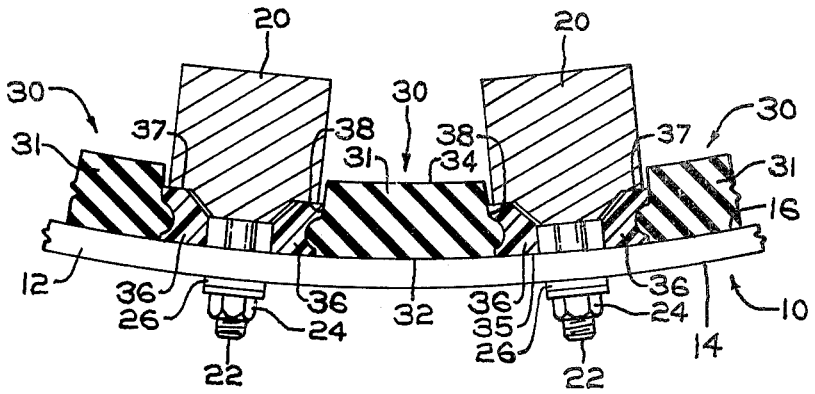
FIG. 1 is an axial cross-section of a portion of a rotary drum type mill illustrating liner members of the present invention in position.

In the drawings, where like numerals reference like structural elements throughout the several views, a portion of a typical rotary drum-type mill is generally represented as 10. Mill 10 includes a principal cylindrical wall 12 usually closed by annular end walls (not shown). The wall 12 has an outer surface 14 and an inner surface 16 along which are mounted longitudinally extending, circumferentially spaced steel lifter bars 20 secured to the wall through typical fastening means including threaded bolts 22 disposed in counter bores in lifter bars 20 and which extend through the wall 12. A nut 24 and washer 26 is tightened on each bolt 22 against the outer surface 14 of wall 12. It is understood that lifter bars can also be provided on the interior surface of one or both of the annular end closures of the mill (not shown) in which case the lifters extend generally along radii extending from the longitudinal axis of the mill. As seen in FIG. 1, the spacing between lifter bars 20 is of generally rectangular area. The spacing between lifter bars typically used at the end closures (not shown) will be generally wedge or pie-shaped.

Between each pair of adjacent lifter bars, a liner member 30, made in accordance with the present invention, is positioned to protect an otherwise exposed portion of inner surface 16 of wall 12 from impact, abrasion and wear. Each liner member 30 comprises a longitudinal extending, generally rectangular, block-like, resilient portion 31 having an inner surface 32 flush against inner wall 16 of wall 12 and an outer surface 34 for exposure to abrasion wear and impact from the mill charge. The mill liner member 30 further comprises a pair of longitudinally extending rigid portions one each bonded to one of the two sides or longitudinal margins 38 of resilient portion 31. Each rigid portion 36 has an inner surface 35 flush with inner wall surface 16 and an outer surface 37 disposed in bearing support relationship to the marginal portions of adjacent lifter bars 20. When torqued down, the lifter bars 20 will each bear forcibly upon a rigid portion 36 of an adjacent liner member 30 thereby holding the liner member in place without the need for special fasteners and/or adhesives.

Figure 2:
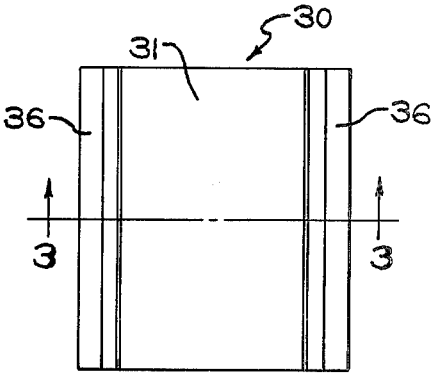
FIG. 2 is a plan view showing one type of liner member according to a presently preferred embodiment of the invention.
Figure 3:
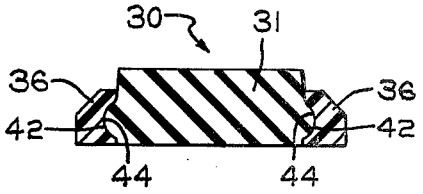
FIG. 3 is a cross-sectional view of the liner member depicted in FIG. 2 taken along lines 3—3 thereof.

For more details of liner member 30, reference is now made to FIGS. 2 and 3 showing a section of a generally rectangular liner member 30 comprising the aforementioned resilient portion 31 with rigid portions 36 bonded to the sides 38. As previously mentioned, although only a generally rectangular liner member is shown by the drawings, this invention is understood to apply to liner members of different shapes such as, for example, a wedge or pie-shaped liner for disposition at the end or closure walls of the mill.

The resilient portion 31 of liner member 30 is preferably a vulcanized elastomeric material having good abrasion, wear, corrosion and impact resistance. Examples of elastomeric materials having such properties and which could be used as portion 31 material are blends of cis-polybutadiene rubber and styrene butadiene or natural rubber where the proportion of the cis-polybutadiene component of the blend is varied according to the particular environment in which the liner member is used.

Each rigid portion 36 bonded along each side of each resilient portion 31 of a liner member 30 is preferably plastic and, more preferably, an ultra-high molecular weight polyethylene plastic material. This particular material has been defined as polyethylene of such molecular weight as to have a melt flow index less than 0.15 measured in accordance with the test procedures of ASTM 1238-65T modified by an additional 3 kg load (see U.S. Pat. No. 3,650,874). Use of this particular plastic material permits the liner member of the present invention to be mold formed as a unitary structure. as an alternative to the necessity of separately forming individual resilient and rigid portions followed by use of special adhesives to join the portions together, if other typical rigid plastics are used. In other words, using such high molecular weight polyethylene for portions such as 36 permits an in-situ type bonding or fusing to occur between the rubber and plastic interfaces of the liner in a mold.

It is noted that liner member 30 is also characterized by an outwardly curved projection 42 at each of its sides along the rubber plastic interface and that each rigid member 36 has a corresponding inwardly curved cavity 44. This particular interfacing feature is due to phenomena occurring in the mold during fabrication of the liner member. It is believed this is due to distinctive reactions taken by the different materials to the heat applied in the mold. Nevertheless, this peculiar interfacing is believed to further enhance the rubber-plastic bond because it provides greater bonding area between the parts and resists shearing action better than if the components were joined along a straight line interface.

The foregoing has described the invention in accordance with a presently preferred embodiment, it being understood that departures from and modifications to such embodiment are possible which departures and modifications would properly fall within the scope of the following claims.

I claim:

1. In a liner member for use in rotary drum type mills having spaced lifter bars at interior surface areas of the mill, which liner member is adapted for disposition between a selected pair of said lifter bars and comprises a resilient portion of vulcanized elastomeric material having a widthwise dimension substantially corresponding to the spacing between said selected pair of lifter bars, the improvement wherein said liner member further comprises a rigid plastic portion bonded along each longitudinal margin of said resilient portion.

2. The liner defined in claim 1 wherein said rigid plastic portions consist essentially of ultra-high molecular weight polyethylene having a melt flow index less than 0.15 measured in accordance with ASTM 1238-65T test procedures modified with a supplementary load of 3kg.

3. The liner defined in claim 1 wherein said resilient portion consists essentially of vulcanized, abrasion resistant elastomeric material.

4. The liner defined in claim 3 wherein said rigid plastic portions consist essentially of ultra-high molecular weight polyethylene having a melt flow index less than 0.15 measured in accordance with ASTM 1238-65T test procedures modified with a supplementary load of 3 kg.

* * * * *